United States Patent [19]

Diab

[11] Patent Number: 4,974,427

[45] Date of Patent: Dec. 4, 1990

[54] COMPRESSOR SYSTEM WITH DEMAND COOLING

[75] Inventor: Tariq A. R. Diab, Anna, Ohio

[73] Assignee: Copeland Corporation, Sidney, Ohio

[21] Appl. No.: 422,769

[22] Filed: Oct. 17, 1989

[51] Int. Cl.[5] ..... F25B 31/00

[52] U.S. Cl. ..... 62/505; 417/292

[58] Field of Search ..... 62/505; 417/292

[56] References Cited

U.S. PATENT DOCUMENTS

| | | | |
|---|---|---|---|
| Re. 30,499 | 2/1981 | Moody, Jr. et al. . | |
| 3,150,277 | 9/1964 | Chubb et al. | 62/505 |
| 3,261,172 | 7/1966 | Grant | 62/505 |
| 3,795,117 | 3/1974 | Moody, Jr. et al. | 62/505 |
| 3,851,494 | 12/1974 | Hess . | |
| 3,859,815 | 1/1975 | Kasahara | 62/505 |
| 3,885,402 | 5/1975 | Moody, Jr. et al. . | |
| 3,913,346 | 10/1975 | Moody, Jr. et al. . | |
| 3,931,718 | 1/1976 | Haselden . | |
| 3,945,220 | 3/1976 | Kosfeld . | |
| 4,006,602 | 3/1976 | Fanberg . | |
| 4,020,642 | 5/1977 | Haselden et al. . | |
| 4,045,974 | 9/1977 | McCarty . | |
| 4,045,975 | 9/1977 | McCarty . | |
| 4,049,410 | 9/1977 | Miller . | |
| 4,084,405 | 4/1978 | Schibbye et al. . | |
| 4,094,165 | 6/1978 | Sisk . | |
| 4,129,012 | 12/1978 | Mairs . | |
| 4,216,661 | 8/1980 | Tojo et al. . | |
| 4,226,604 | 10/1980 | Weis . | |
| 4,258,553 | 3/1981 | Kelly et al. . | |
| 4,261,180 | 4/1981 | Nozawa et al. . | |
| 4,262,492 | 4/1981 | Morita et al. . | |
| 4,326,868 | 4/1982 | Ozu et al. . | |
| 4,694,660 | 9/1987 | Gannaway . | |
| 4,739,632 | 4/1988 | Fry . | |
| 4,742,689 | 5/1988 | Lowes . | |

*Primary Examiner*—Ronald C. Capossela

*Attorney, Agent, or Firm*—Harness, Dickey & Pierce

[57] ABSTRACT

A refrigeration system is disclosed which incorporates apparatus for preventing overheating of the compressor by selectively feeding liquid refrigerant from the outlet of the condenser to the compressor. In one embodiment the refrigerant fluid from the compressor is injected into the suction manifold of the compressor. In another embodiment this fluid is injected directly into the compression chamber or chambers. Control means are provided which include a temperature sensor located within the compressor discharge chamber and valve means responsive thereto to control the flow of liquid refrigerant to the suction manifold or compression chamber.

22 Claims, 4 Drawing Sheets

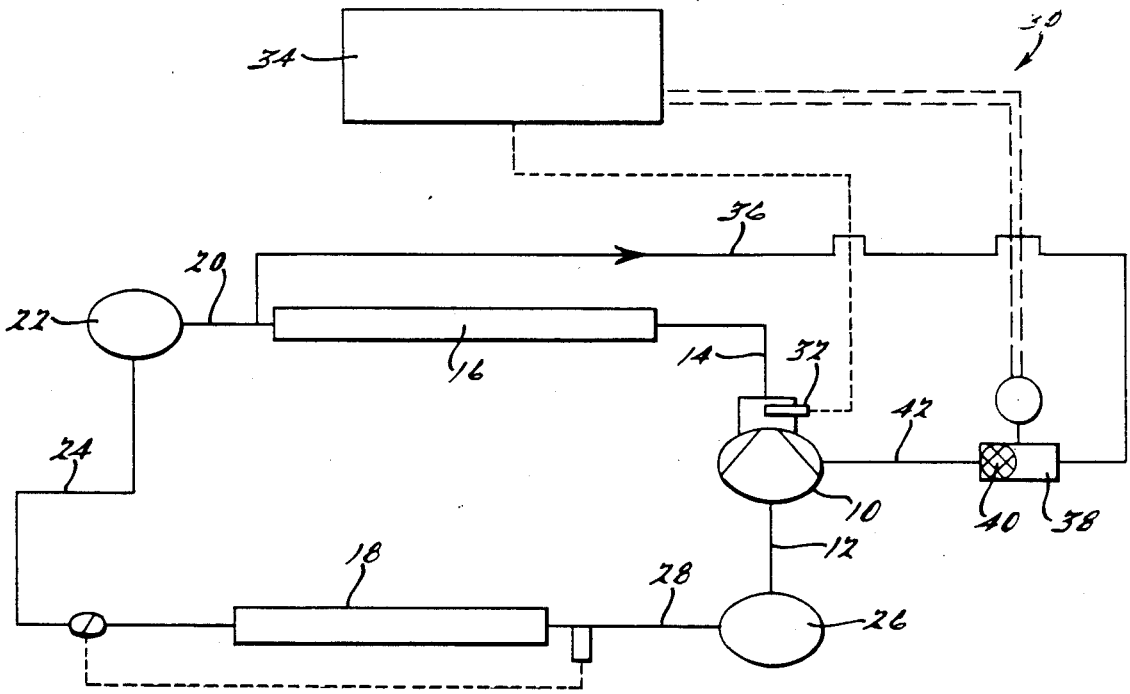
FIG. 1.
FIG. 2.
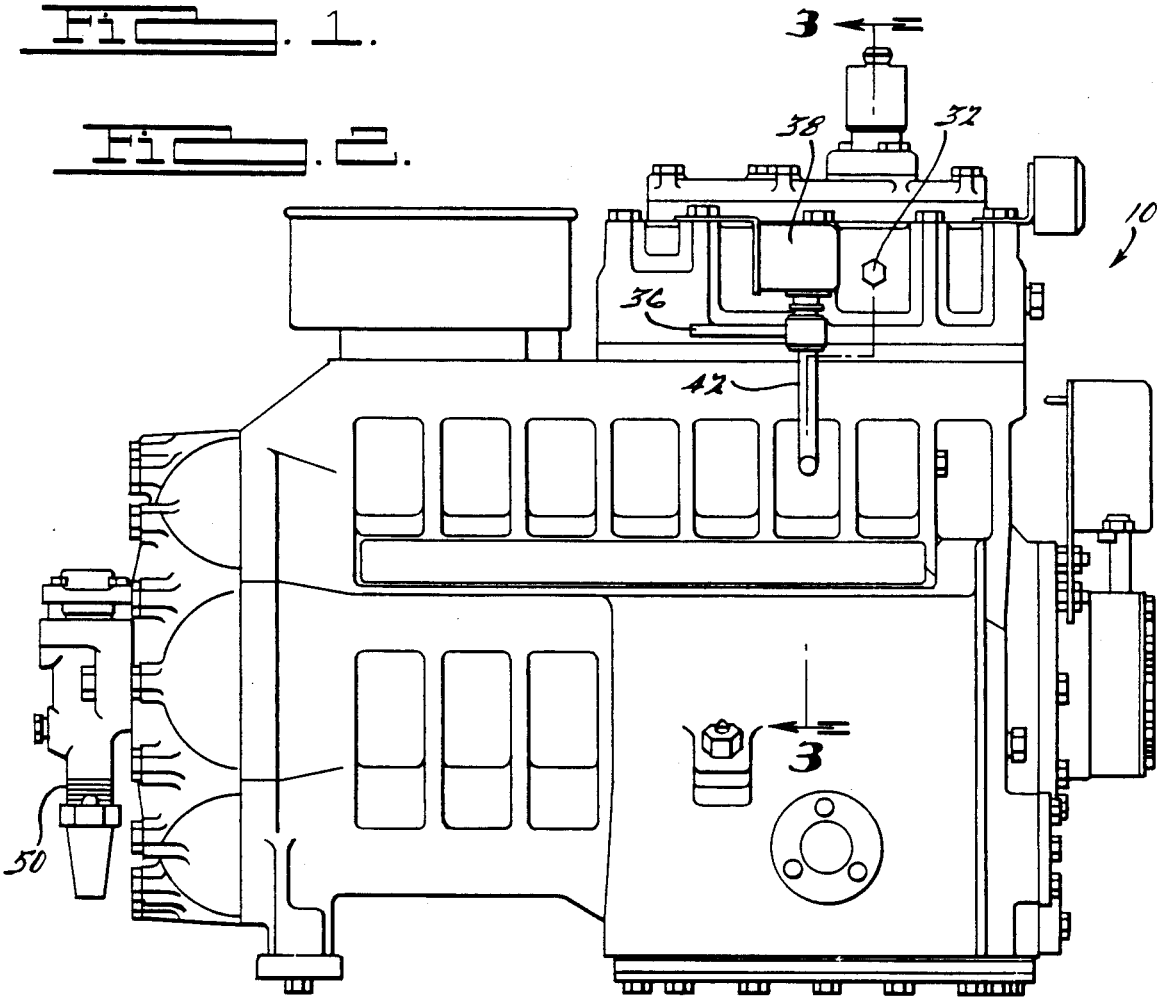

FIG. 3.
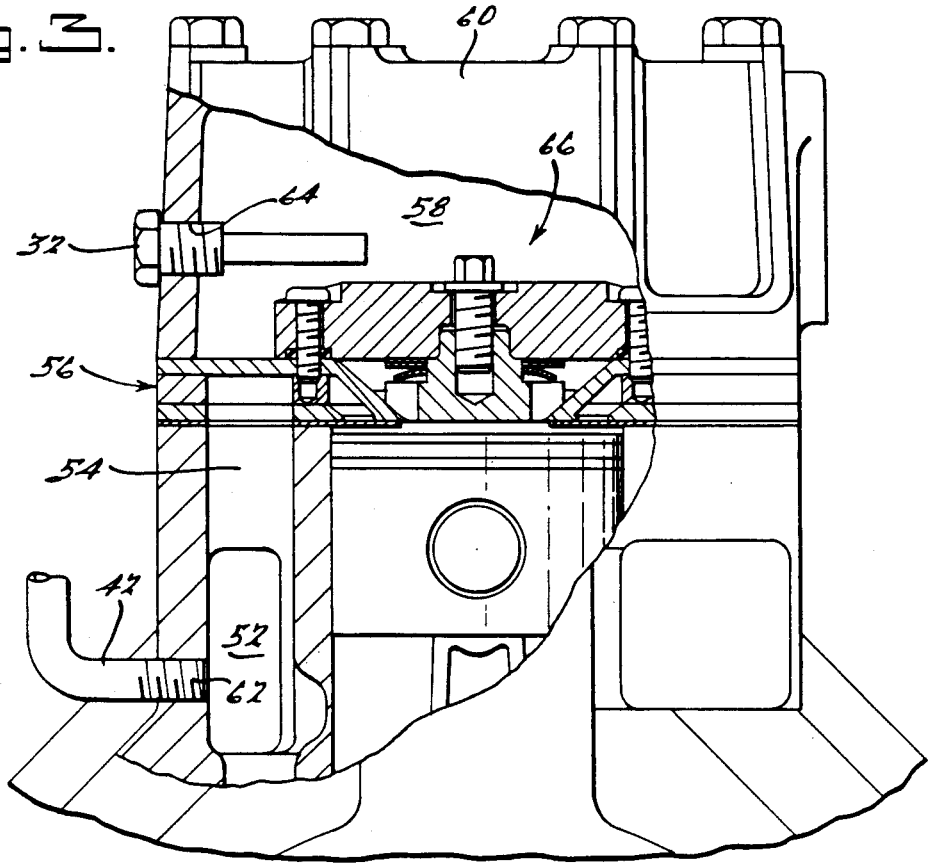
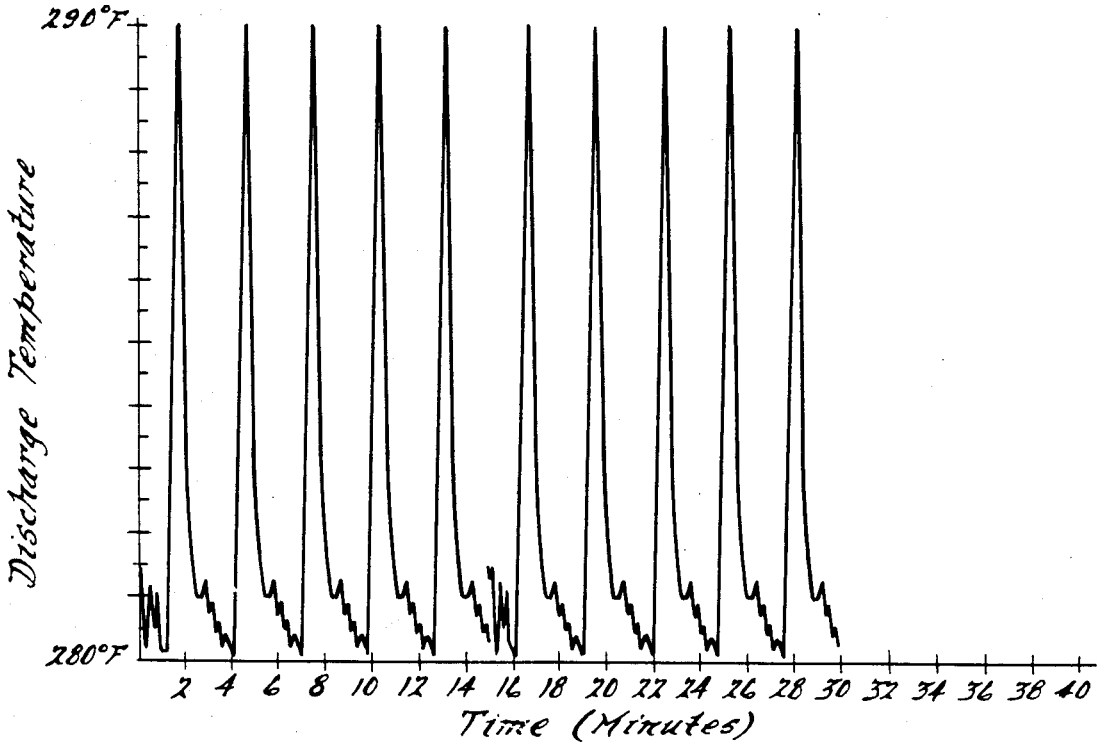
FIG. 5.

COMPRESSOR SYSTEM WITH DEMAND COOLING

BACKGROUND AND SUMMARY OF THE INVENTION

The present invention relates generally to refrigeration systems and more particularly to refrigeration systems incorporating means to prevent overheating of the compressor by selectively injecting liquid refrigerant into the suction manifold.

In response to recent concerns over depletion of the ozone layer due to release of various types of refrigerants such as R12, the government has imposed increasingly stricter limitations on the use of these refrigerants. These limitations will require refrigeration systems of the future to utilize substitute refrigerants. Presently, the available substitutes for commonly used refrigerants such as R-12 and R-502 are not well suited for low temperature applications because they result in high discharge temperatures which may damage or shorten the life expectancy of the compressor particularly under high load situations and high compression ratios.

Liquid injection systems have long been used in refrigeration systems in an effort to limit or control excessive discharge gas temperatures which cause overheating of the compressor and may result in breakdown of the compressor lubricant. Typically, these prior systems utilized capillary tubes or thermal expansion valves to control the fluid injection. However, such systems have been very inefficient and the capillary tubes and thermal expansion valves were prone to leaking during periods when such injection cooling was not needed. This leakage could result in flooding of the compressor. Additionally, when the compressor was shut down, the high pressure liquid could migrate from the receiver to the low pressure suction side through these capillary tubes or expansion valves thereby resulting in slugging of the compressor upon startup. Also, the thermal sensors utilized by these prior systems were typically located in the discharge line between the compressor and condenser. This positioning of the sensor often resulted in inadequate cooling as the sensed temperature could vary greatly from the actual temperature of the discharge gas exiting the compression chamber due to a variety of factors such as the ambient temperature around the discharge line and the mass flow rate of discharge gas. Thus overheating of the compressor could occur due to an erroneous sensed temperature of the discharge gas.

The present invention, however, overcomes these problems by providing a liquid injection system which utilizes a temperature sensor positioned within the discharge chamber of the compressor in close proximity to and in direct contact with the compressed gas exiting the compression chamber. Thus a more accurate indication of the compressor heating is achieved which is not subject to error due to external variables. Further, the present invention employs in a presently preferred embodiment a positive acting solenoid actuated on/off valve coupled with a preselected orifice which prevents leakage of high pressure liquid during periods when cooling is not required. Additionally, the orifice is sized for a maximum flow rate such that it will be able to accommodate the cooling requirements while still avoiding flooding of the compressor. The term "liquid injection" is used herein to denote that it is liquid refrigerant which is taken from the condenser in such systems but in reality a portion of this liquid will be vaporized as it passes through the capillary tube, expansion valve or other orifice thus providing a two phase (liquid and vapor) fluid which is injected into the compressor. The present invention also injects the fluid (i.e. 2 phase fluid) directly into the suction chamber at a location selected to assure even flow of the injected fluid to each compression chamber so as to thereby maximize compressor efficiency as well as to insure a maximum and even cooling effect.

In another embodiment of the present invention the refrigerant fluid is injected directly into the compression chamber preferably immediately after the suction ports or valve has been closed off thus acting to cool both the compression chamber and suction gas contained therein. While this arrangement offers greater efficiency in operation, it tends to be more costly as additional controls and other hardware are required for its implementation.

Additional advantages and features of the present invention will become apparent from the subsequent description and the appended claims taken in conjunction with the accompanying drawings.

BRIEF DESCRIPTION OF THE DRAWINGS

FIG. 1 is a schematic diagram of a refrigeration system incorporating a demand cooling liquid injection system in accordance with the present invention;

FIG. 2 is a side view of a refrigeration compressor having the injection system of the present invention installed thereon all in accordance with the present invention;

FIG. 3 is a fragmentary section view of the refrigeration compressor of FIG. 1, the section being taken along lines 3—3 of FIGS. 2 and 4;

FIG. 6 is a section view similar to that of FIG. 4 but showing another refrigeration compressor having the demand cooling liquid injection system of the present invention installed thereon.

DESCRIPTION OF THE PREFERRED EMBODIMENTS

Figure 4:
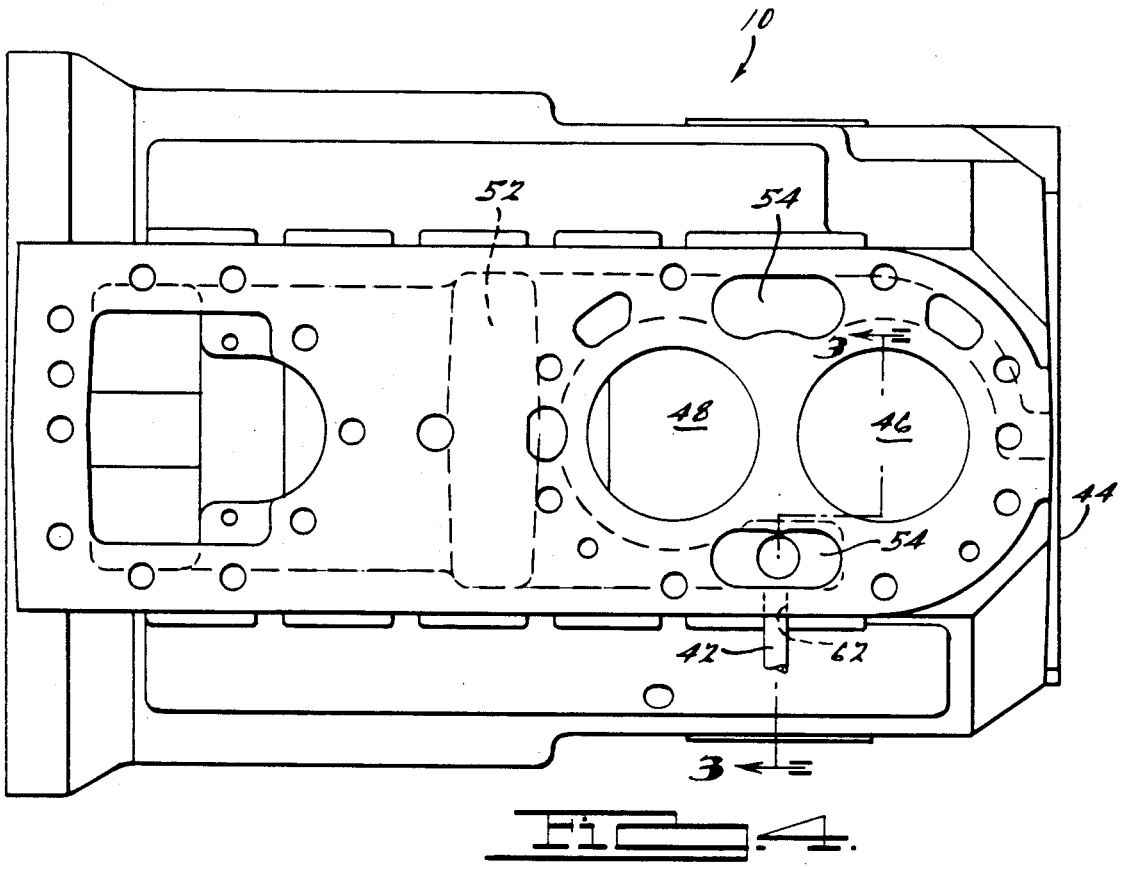
FIG. 4 is a top view of the refrigeration compressor of FIG. 2 with the head removed therefrom.

Referring now to the drawings and more particularly to FIG. 1, there is shown a typical refrigeration circuit including a compressor 10 having a suction line 12 and discharge line 14 connected thereto. Discharge line 14 extends to a condenser 16 the output of which is supplied to an evaporator 18 via lines 20, receiver 22 and line 24. The output of evaporator 18 is thence fed to an accumulator 26 via line 28 the output of which is connected to suction line 12. As thus described, this refrigeration circuit is typical of such systems employed in both building air conditioning or other refrigerating systems.

The present invention, however, provides a unique demand cooling fluid injection system indicated generally at 30 which operates to prevent potential overheating of the compressor. Fluid injection system incorporates a temperature sensor 32 positioned within the compressor 10 which operates to provide a signal to an electronic controller 34 which signal is indicative of the temperature of the compressed gas being discharged from the compressor 10. A fluid line 36 is also provided having one end connected to line 20 at or near the output of condenser 16. The other end of fluid line 36 is connected to a solenoid actuated valve 38 which is operatively controlled by controller 34. The output from solenoid valve 38 is fed through a restricted orifice 40 to an injection port provided on compressor 10 via line 42.

As best seen with reference to FIGS. 2 through 4, compressor 10 is of the semi-hermetic reciprocating piston type and includes a housing 44 having a pair of compression cylinders 46, 48 disposed in longitudinally aligned side-by-side relationship. Housing 44 has a suction inlet 50 disposed at one end thereof through which suction gas is admitted. Suction gas then flows through a motor chamber provided in the housing and upwardly to a suction manifold 52 (indicated by the dotted lines in FIG. 4) which extends forwardly and in generally surrounding relationship to cylinders 46, 48. A plurality of passages 54 serve to conduct the suction gas upwardly through a valve plate assembly 56 whereupon it is drawn into the respective cylinders 46, 48 for compression. Once the suction gas has been compressed within cylinders 46, 48, it is discharged through valve plate assembly 56 into a discharge chamber 58 defined by overlying head 60.

As best seen with reference to FIGS. 3 and 4, line 42 is connected to an injection port 62 provided in the sidewall of housing 44 and opening into suction manifold 52 at a location substantially centered between cylinders 46, 48 and directly below passage 54. The location of this injection port was determined experimentally to optimize efficiency and to insure even cooling of each of the two cylinders. Preferably this location will be selected for a given compressor model such that the compressed gas exiting from each of the respective compression chambers will be within a predetermined range relative to each other (i.e. from hottest to coolest) and more preferably these temperatures will be approximately equal. It should be noted that it is desirable to inject the liquid as close to the cylinders as possible to optimize operational efficiency.

Also as best seen with reference to FIGS. 2 and 3, temperature sensor 32 is fitted within an opening 64 provided in head 60 and extends into discharge chamber 58 so as to be in direct contact with the discharge gas entering from respective cylinders 46, 48. Preferably sensor 32 will be positioned at a location approximately centered between the two cylinders 46, 48 and as close to the discharge valve means 66 as possible so as to insure an accurate temperature is sensed for each of the respective cylinders. It is believed that this location will place the temperature sensor closest to the hottest compressed gas exiting from the compression chambers.

Solenoid actuated valve 38 will preferably be an on/-off type valve having a capability for a very high number of duty cycles while also assuring a leak resistant off position so as to avoid the possibility of compressor flooding or slugging. Alternatively, solenoid valve could be replaced by a valve having the capability to modulate the flow of liquid into suction manifold 52 in response to the sensed temperature of the discharge gas. For example, a stepping motor driven valve could be utilized which would open progressively greater amounts in response to increasing discharge temperature. Another alternative would be to employ a pulse width modulated valve which would allow modulation of the injection fluid flow by controlling the pulse duration or frequency in response to the discharge temperature.

In order to limit the maximum flow of fluid into suction manifold 52 via injection port 62 as well as to reduce the pressure of the fluid to approximately that of the suction gas flowing from the evaporator, an orifice 40 is provided downstream of valve 38. Preferably orifice 40 will be sized to provide a maximum fluid flow therethrough at a pressure differential of about 300 psi which corresponds to an evaporator temperature of about −40° F. and a condenser temperature of about 130° F. so as to assure adequate cooling liquid is provided to compressor 10 to prevent overheating thereof. Evaporator temperature refers to the saturation temperature of the refrigerant as it enters the evaporator and has passed through the expansion valve. Condenser temperature refers to the saturation temperature of the refrigerant as it leaves the condenser. This represents a worst case design criteria. The maximum flow will vary between different compressors and will be sufficient to prevent the discharge temperature of the compressor from becoming excessively high yet not so high as to cause flooding or slugging of the compressor. It should be noted that it is important that orifice 40 be sized to create a pressure drop thereacross which is substantially equal to the pressure drop occurring between the condenser outlet and the compressor suction inlet across the evaporator so as to prevent subjecting the evaporator to a back pressure which may result in excessive system efficiency loss.

Figure 5:
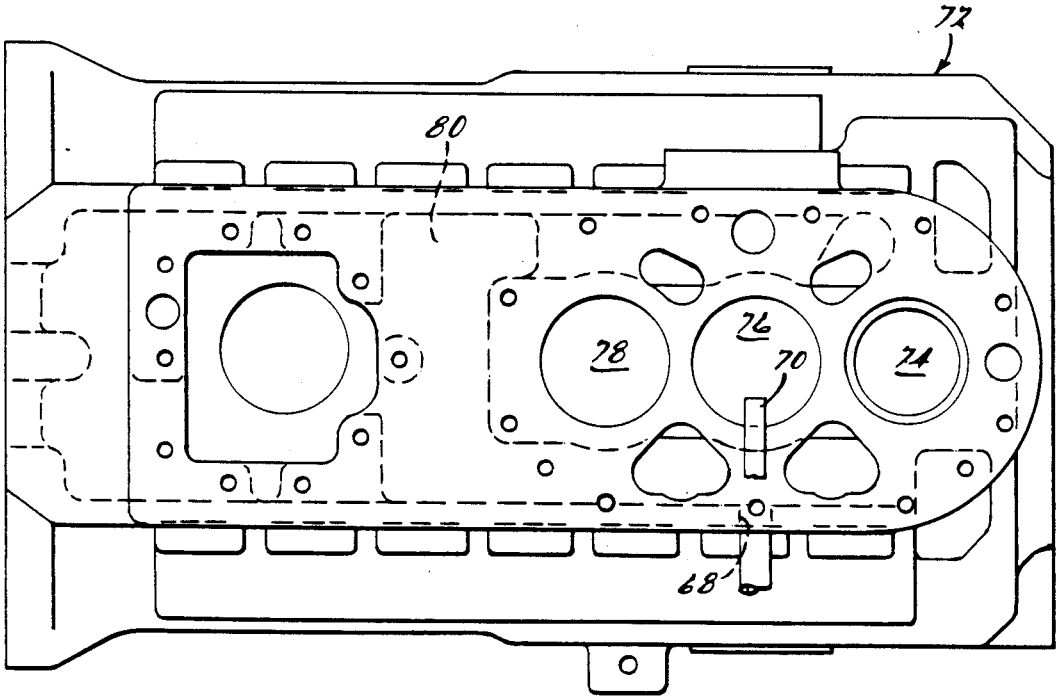
FIG. 5 shows an exemplary plot of discharge temperature as a function of time for a compressor employing the injection cooling system of the present invention.

In operation, upon initial startup from a "cold" condition, valve 38 will be in a closed condition as the temperature of compressor 10 as sensed by sensor 32 will be low enough not to require any additional cooling. Thus, the refrigeration circuit will function in the normal manner with refrigerant being circulated through condenser 16, receiver 22, evaporator 18, accumulator 26 and compressor 10. However, as the load upon the refrigeration system increases, the temperature of the discharge gas will increase. When the temperature of the discharge gas exiting the compression chambers of compressor 10 as sensed by sensor 32 reaches a first predetermined temperature as shown by the spikes in the graph of FIG. 5, controller 34 will actuate valve 38 to an open position thereby allowing high pressure liquid refrigerant exiting condenser 16 to flow through line 36, valve 38, orifice 40, line 42 and be injected into the suction manifold 52 of compressor 10 via port 62. It should be noted that the liquid refrigerant will normally be partially vaporized as it passes through orifice 40 and hence the fluid entering through port 62 will typically be two phase (part gas, part liquid). This cool liquid refrigerant will mix with the relatively warm suction gas flowing through manifold 52 and be drawn into the respective cylinders 46, 48. The vaporization of this liquid refrigerant will cool both the suction gas and the compressor itself thereby resulting in a lowering of the temperature of the discharge gas as sensed by sensor 32 and as shown in the graph of FIG. 5. Once the discharge temperature sensed by sensor 32 drops below a second predetermined temperature, controller 34 will operate to close valve 38 thereby shutting off the flow of liquid refrigerant until such time as the temperature of the discharge gas sensed by sensor 32 again reaches the first predetermined temperature. Preferably, the first predetermined temperature at which valve 38 will be opened will be below the temperature at which any degradation of the compressor operation or life expectancy will occur and in particular below the temperature at which any degradation of the lubricant utilized within compressor 10 occurs. The second predetermined temperature will preferably be set sufficiently below the first predetermined temperature so as to avoid excessive rapid cycling of valve 38 yet high enough to insure against possible flooding of the compressor. In a preferred embodiment of the present invention, the first predetermined temperature was set at about 290° F. and the second predetermined temperature was set at about 280° F. The graph of FIG. 5 shows the resulting discharge temperature variation as a function of time for these predetermined temperatures at −25° F. evaporating temperature, 110° F. condensing temperature and 65° F. return temperatures. Return temperature refers to the temperature of the refrigerant returning from the evaporator as it enters the compressor.

As noted above, positioning of the sensor 32 and the injection port 62 is very important for insuring proper even cooling of the compressor and for maximizing operating efficiency of the system. FIG. 6 shows the position of injection port 68 and discharge gas sensor 70 in a semi-hermetic compressor 72 having three compression cylinders 74, 76, 78. Port 68 opens into suction manifold 80 (outlined by dotted lines and extending along both sides of the two rearmost cylinders) provided within the compressor housing and is preferably centered on the middle cylinder 76. Similarly, sensor 70 extends inwardly through the head (not shown) and is positioned in closely overlying relationship to the center cylinder 76 so as to be exposed to direct contact with the compressed discharge gas exiting from each of the three cylinders. Again, it is believed that this location will place the sensor closest to the hottest compressed gas exiting from the respective compression chambers as is believed preferable. The operation of this embodiment will be substantially identical to that described above.

Figure 7:
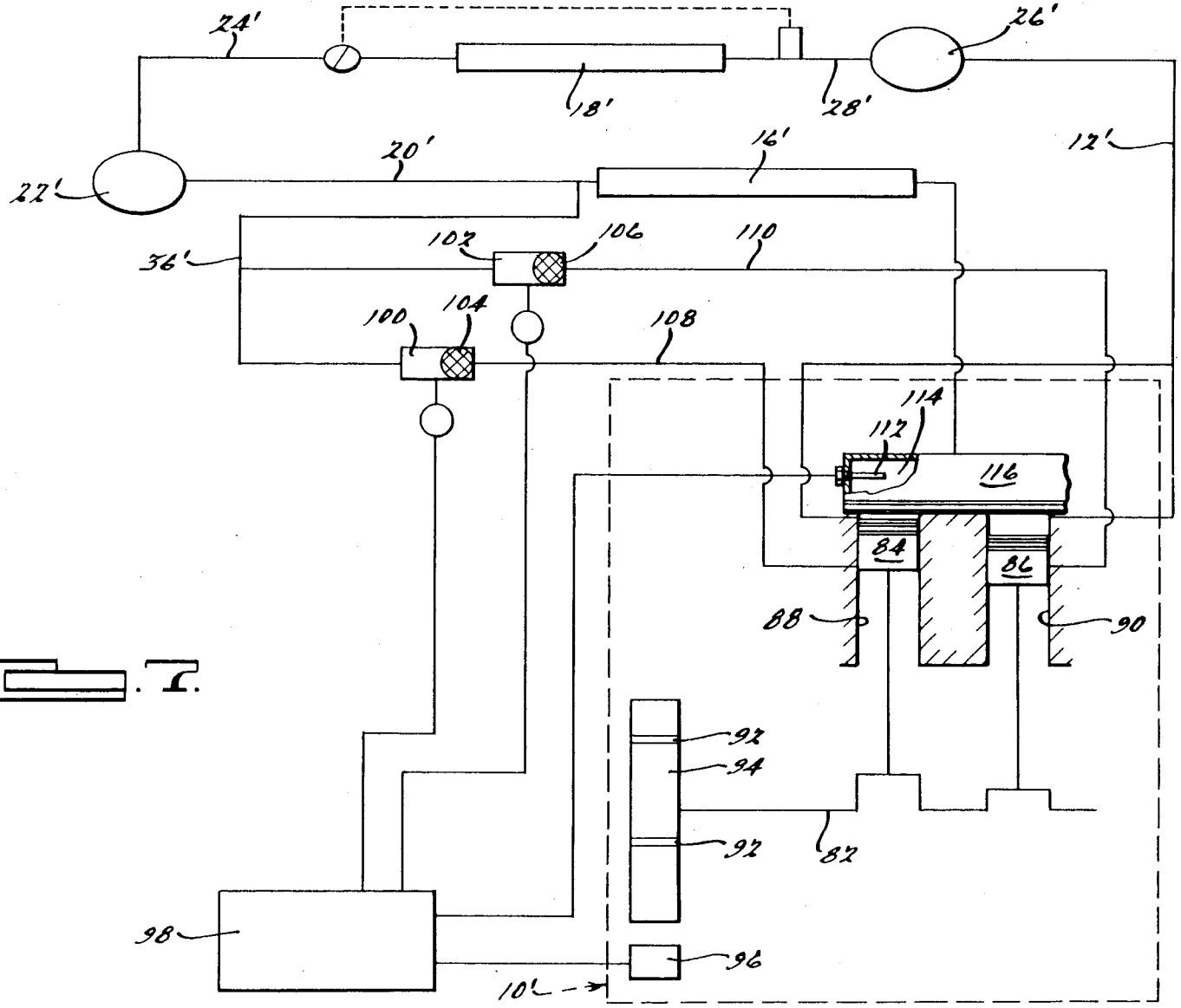
FIG. 7 is a schematic view of a refrigeration system similar to FIG. 1 but showing an alternative embodiment of the present invention incorporated therein.

Referring now to FIG. 7, there is shown a refrigeration system similar to that shown in FIG. 1 incorporating the same components indicated by like reference numbers primed. However, this refrigeration system incorporates an alternative embodiment of the present invention wherein the refrigerant fluid is injected directly into each of the respective cylinders as soon as the piston has completed its suction stroke (i.e. just as the piston passes its bottom dead center position). This embodiment offers even greater improvements in system operating efficiency in that the fluid being injected does not displace any of the suction gas being drawn into the compressor but rather adds to the fluid being compressed thus resulting in greater mass flow for each stroke of the piston.

As shown in FIG. 7, compressor 10' has a crankshaft 82 operative to reciprocate pistons 84, 86 within respective cylinders 88, 90. A plurality of indicia 92 equal in number to the number of cylinders provided within compressor 10' are provided on a rotating member 94 associated with crankshaft 82 which are designed to be moved past and sensed by sensor 96 as crankshaft 82 rotates. Indicia 92 will be positioned relative to sensor 96 such that sensor 96 will produce a signal indicating that a corresponding piston is moving past bottom dead center. These signals generated by sensor 96 will be supplied to controller 98.

In order to supply refrigerant fluid to each of the respective cylinders 88, 90, a pair of suitable valves 100, 102 are provided each of which has an input side connected to fluid line 36' and is designed to be actuated between on/off positions by controller 98 as described in greater detail below. An orifice 104, 106 is associated with each of the respective valves 100, 102. Orifice 104, 106 perform substantially the same functions as orifice 40 described above except that they will be designed to maintain the fluid to be injected into the cylinders somewhat above the pressure of the suction gas within the cylinders at the time the fluid is to be injected which pressure may be above that of the suction gas returning from the evaporator.

The outputs of respective valves 100, 102 and orifices 104, 106 will be supplied to respective cylinders 88, 90 via fluid lines 108, 110 respectively which may communicate with cylinders 88, 90 through any suitable porting arrangement such as openings provided in the sidewall of the respective cylinders or through a valve plate associated therewith. Additionally, suitable check valves may be provided to prevent any backflow of refrigerant during the compression stroke if desired.

A sensor 112 is also provided being disposed within a discharge chamber 114 defined by head 116 and operative to send a signal indicative of the temperature of the compressed gas exiting cylinders 88, 90 to controller 98. Sensor 112 is substantially identical to sensors 32 and 70 described above and will be positioned within discharge chamber 114 in a substantially identical manner to and will function in the same manner as described with reference to sensors 32 and 70.

In operation, when sensor 112 indicates to controller 98 that the temperature of the compressed gas exiting cylinders 88, 90 exceeds a predetermined temperature, controller 98 will begin looking for actuating signals from sensor 96. As indicia 92 carried by crankshaft 82 passes sensor 96, a signal indicating that one of pistons 84 and 86 is passing bottom dead center is provided to controller 98 which in turn will then actuate the corresponding one of valves 100 and 102 to an open position for a brief predetermined period of time whereby refrigerant fluid will be allowed to flow into the corresponding cylinder thus mixing with and cooling the suction gas previously drawn into the cylinder for compression. This cycle will be repeated for the other of cylinders 88, 90 as the next indicia 92 moves past sensor 96 carried by crankshaft 82 thereby providing a supply of cooling refrigerant fluid to that cylinder. The actual time periods for which valves 100 and 102 are maintained in an open position will be selected so as to provide a sufficient cooling to avoid excessive overheating of compressor 10' while avoiding the possibility of causing a flooding or slugging of the respective cylinders. In some applications it may be desirable to vary the length of time the respective valves are maintained in an open condition in response to the magnitude by which the temperature of the discharge gas as sensed by sensor 112 exceeds a predetermined temperature. In any event, once the temperature of the compressed gas sensed by sensor 112 drops below a second predetermined temperature, controller 98 will cease actuation of respective valves 100 and 102 and the refrigerant system will operate in a conventional manner without any fluid injection.

It should be noted that while the present invention has been described in connection with reciprocating piston type compressors, it is also equally applicable to other types of compressors such as rotary, screw, scroll or any other type thereof. Because the present invention employs a sensor exposed directly to the discharge gas as it exits the compression chamber or chambers, the possibility of erroneous readings due to external factors is substantially eliminated. Further, the use of a positive control valve insures that cool liquid will only be supplied at those times that it is necessary to effect cooling of the compressor. Also, the provision of a properly sized orifice limits maximum liquid flow so as to insure that flooding of the compressor will not occur.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

I claim:

1. In a refrigeration system including a compressor having a suction manifold and a discharge chamber, a condenser, and an evaporator connected to said compressor in a serial closed loop system, improved means for preventing overheating of said compressor comprising sensor means within said discharge chamber of said compressor and in the flowpath of said compressed gas for sensing the temperature of compressed gas therein, a fluid line connected between the outlet of said condenser and said compressor suction manifold and control means operative to selectively control fluid flow from said condenser outlet to said suction manifold in response to said sensed temperature of said compressed gas, wherein said compressor includes a plurality of compression chambers, each of said compression chambers receiving suction gas from said suction manifold and discharging said compressed gas into said discharge chamber via respective discharge ports said sensor means being located within said discharge chamber closest to the discharge port through which said compressed gas having the highest temperature enters said discharge chamber.

2. A refrigeration system as set forth in claim 1 wherein said control means include valve means disposed within said fluid line.

3. A refrigeration system as set forth in claim 2 wherein said valve means is actuable between open and closed positions to thereby selectively control said fluid flow.

4. A refrigeration system as set forth in claim 2 wherein said valve means is operable to modulate said fluid flow.

5. A refrigeration system as set forth in claim 4 wherein said valve means is a pulse width modulated valve.

6. A refrigeration system as set forth in claim 3 wherein said control means is operable to actuate said valve means to an open position at a first predetermined temperature and to actuate said valve means to a closed position at a second predetermined temperature.

7. A refrigeration system as set forth in claim 1 wherein said compressor includes a plurality of compression chambers each of said chambers receiving suction gas from said suction manifold and discharging compressed gas into said discharge chamber, said fluid line opening into said suction manifold at a location selected to insure the temperature of said compressed gas exiting each of said compression chambers is below a first predetermined temperature.

8. A refrigeration system as set forth in claim 7 wherein said location is selected to insure the temperature of said compressed gas exiting from each of said compression chambers is within a predetermined range relative to each other when said control means allows fluid flow through said fluid line.

9. A refrigeration system as set forth in claim 8 wherein said location is selected to insure the temperature of said compressed gas exiting from each of said compression chambers is substantially equal.

10. A refrigeration system as set forth in claim 1 wherein said fluid line opens into said suction manifold at a location selected to insure the temperature of said compressed gas exiting each of said compression chambers is below a first predetermined temperature.

11. A refrigeration system as set forth in claim 2 wherein said control means further includes an orifice positioned in said fluid line between said valve means and said suction manifold, said orifice being operative to limit flow of fluid through said fluid line.

12. A refrigeration system as set forth in claim 1 wherein said orifice is sized to provide a pressure drop thereacross sufficient to avoid subjecting said evaporator back pressure when said valve means is in an open condition.

13. In a refrigeration system including a compressor having a suction manifold, a discharge chamber, and a plurality of compression chambers, a condenser, an evaporator and means interconnecting said compressor, condenser and evaporator in a serial closed loop system, said suction manifold being operative to supply suction gas to each of said plurality of compression chambers and each of said compression chambers being operative to discharge compressed gas into said discharge chamber via discharge ports associated with each of said compression chambers, improved means for preventing overheating of said compressor comprising sensor means positioned within said discharge chamber substantially centrally of said discharge ports so as to be in direct contact with said compressed gas entering said discharge chamber, said sensor means being operative to sense the temperature of said compressed gas, a fluid line extending between the outlet of said condenser and said suction manifold of said compressor and control means operative to allow fluid flow from said condenser outlet to said suction manifold in response to said sensor means sensing a temperature above a first predetermined temperature and to prevent said fluid flow in response to said sensor means sensing a temperature below a second predetermined temperature whereby overheating of said compressor may be inhibited.

14. A refrigeration system as set forth in claim 13 wherein said compressor includes passages for conducting suction gas from said suction manifold to respective ones of said compression chambers and said fluid line opens into said suction manifold at a location selected such that the highest temperature of said compressed gas exiting from respective ones of said compression chambers is within a predetermined range of the lowest temperature of said compressed gas exiting from respective ones of said compression chambers.

15. A refrigeration system as set forth in claim 14 wherein said highest temperature and said lowest temperature are approximately equal.

16. A refrigeration system as set forth in claim 14 wherein said sensor is positioned within said discharge chamber closer to said discharge port from which said compressed gas having the highest temperature exits than to other of said discharge ports.

17. A refrigeration system as set forth in claim 16 wherein said compressor is a reciprocating piston type compressor.

18. A refrigeration system as set forth in claim 13 wherein said control means include valve means within said fluid line actuable to an open position to allow fluid flow to said suction manifold in response to a sensed temperature above said first predetermined temperature and to a closed position to prevent fluid flow through said fluid line in response to a sensed temperature below said second predetermined temperature.

19. A refrigeration system as set forth in claim 18 further comprising an orifice in said fluid line between said valve means and said suction manifold, said orifice being operative to limit flow through said fluid line to thereby inhibit flooding of said compressor.

20. In a refrigeration system including a compressor having a suction manifold and discharge chamber, a condenser, and an evaporator connected to said compressor in a serial closed loop system, improved means for preventing overheating of said compressor comprising sensor means within said discharge chamber of said compressor and in the flowpath of said compressed gas for sensing the temperature of compressed gas therein, a fluid line connected to the outlet of said condenser and to said compressor and control means operative to selectively control fluid flow from said condenser outlet to said compressor in response to said sensed temperature of said compressed gas, wherein said control means include selectively actuable valve means within said fluid line, said fluid line opening into said compression chamber, and said valve means being actuable to an open position at or subsequent to when filling of said compression chamber with suction gas has been competed, and further comprising timing means for providing a signal to said control means indicating that filling of said compression chamber with suction gas has been completed.

21. A refrigeration system as set forth in claim 20 wherein said compressor is a reciprocating piston compressor and said timing means is operative to provide a signal to said controller indicating that said piston is at bottom dead center.

22. In a refrigeration system including a compressor having a suction manifold and a discharge chamber, a condenser, and an evaporator connected to said compressor in a serial closed loop system, improved means for preventing overheating of said compressor comprising sensor means within said discharge chamber of said compressor and in the flowpath of said compressed gas for sensing the temperature of compressed gas therein, a fluid line connected to the outlet of said condenser and to said compressor and control means operative to selectively control fluid flow from said condenser outlet to said compressor in response to said sensed temperature of said compressed gas, wherein said compressor includes a plurality of compression chambers, an injection fluid line opening into each of said chambers, valve means provided in each of said injection fluid lines, said fluid line being connected to each of said valve means and said control means is operable to actuate selective ones of said valve means to thereby control fluid flow from said condenser outlet to selective ones of said compressor chambers.

* * * * *

UNITED STATES PATENT AND TRADEMARK OFFICE

CERTIFICATE OF CORRECTION

PATENT NO. : 4,974,427

DATED : December 4, 1990

INVENTOR(S) : Tariq A.R. Diab

It is certified that error appears in the above-identified patent and that said Letters Patent is hereby corrected as shown below:

On the title page, reference 4,006,602, "3/1976" should be -- 2/1977 --.

Column 8, line 24, "l" should be -- 11 --.

Column 10, lines 4-5, "competed" should be -- completed --.

Signed and Sealed this

Eighth Day of September, 1992

*Attest:*

DOUGLAS B. COMER

*Attesting Officer*

*Acting Commissioner of Patents and Trademarks*